US010399768B2

(12) United States Patent
Bertolin

(10) Patent No.: US 10,399,768 B2
(45) Date of Patent: Sep. 3, 2019

(54) PACKAGING STRUCTURE FOR CONTAINERS FOR PHARMACEUTICAL USE

(71) Applicant: NUOVA OMPI S.R.L., Padua (IT)

(72) Inventor: Gianpaolo Bertolin, Noale (IT)

(73) Assignee: NUOVA OMPI S.R.L., Padua (IT)

( * ) Notice: Subject to any disclaimer, the term of this patent is extended or adjusted under 35 U.S.C. 154(b) by 0 days.

(21) Appl. No.: 15/553,128

(22) PCT Filed: Feb. 19, 2016

(86) PCT No.: PCT/EP2016/053531
§ 371 (c)(1),
(2) Date: Aug. 23, 2017

(87) PCT Pub. No.: WO2016/135051
PCT Pub. Date: Sep. 1, 2016

(65) Prior Publication Data

US 2018/0057249 A1 Mar. 1, 2018

(30) Foreign Application Priority Data

Feb. 23, 2015 (IT) ..... MI2015A0269

(51) Int. Cl.
*B65D 1/34* (2006.01)
*B65D 6/04* (2006.01)
(Continued)

(52) U.S. Cl.
CPC ..... *B65D 85/42* (2013.01); *B65D 71/70* (2013.01)

(58) Field of Classification Search
CPC ..... B65D 85/42; B65D 71/70; A61L 2202/23; A61L 2/07; A61M 5/002; A61M 5/008
(Continued)

(56) References Cited

U.S. PATENT DOCUMENTS

2011/0226662 A1* 9/2011 Nicoletti ..... B65D 5/503 206/562
2012/0181285 A1 7/2012 Krauss et al.
(Continued)

FOREIGN PATENT DOCUMENTS

WO 2011/135085 A1 11/2011
WO 2014/128133 A1 8/2014
WO 2014/130349 A1 8/2014

OTHER PUBLICATIONS

International Search Report dated Jun. 2, 2016 during the prosecution of PCT/EP2016/053531.
(Continued)

*Primary Examiner* — Rafael A Ortiz
(74) *Attorney, Agent, or Firm* — Troutman Sanders LLP

(57) ABSTRACT

The packaging structure for containers for pharmaceutical use comprises a support surface (2) for the containers (3), a tray (4) configured to support the support surface (2) inside it, and demarcation elements (6) which extend on the support surface (2) and delimit with the support surface (2) a plurality of cells (5), in each of which a container may be positioned (3), each cell (5) having a bottom wall (9) for supporting the container (3) and side walls (10) for containing the lateral movement of the container (3), said bottom wall (9) of the cell (5) having along its entire perimeter solid portions (11) for the container (3) to rest on, alternating with empty portions (12) enabling the passage of a device (13) for handling the container (3).

9 Claims, 5 Drawing Sheets

(51) Int. Cl.
*B65D 85/42* (2006.01)
*B65D 71/70* (2006.01)

(58) Field of Classification Search
USPC ..... 206/557–562, 507, 364, 365, 569; 220/529, 629
See application file for complete search history.

(56) References Cited

U.S. PATENT DOCUMENTS

| | | | | |
|---|---|---|---|---|
| 2012/0181288 | A1 | 7/2012 | Krauss et al. | |
| 2013/0048531 | A1* | 2/2013 | Nicoletti | A61M 5/002 206/557 |
| 2015/0122693 | A1* | 5/2015 | Deutschle | B65D 25/108 206/562 |

OTHER PUBLICATIONS

Written Opinion of the International Search Authority dated Sep. 1, 2016 during the prosecution of PCT/EP2016/053531.
Japanese Office Action issued in corresponding Japanese Patent Application No. 2017-544653 dated Feb. 26, 2019 (English translation only).

* cited by examiner

PACKAGING STRUCTURE FOR CONTAINERS FOR PHARMACEUTICAL USE

CROSS-REFERENCE TO RELATED APPLICATIONS

This is a U.S. national phase application under 35 U.S.C. § 371 of International Patent Application No. PCT/EP2016/053531, filed Feb. 19, 2016, and claims benefit of priority to Italian Patent Application No. MI2015A 000269, filed Feb. 23, 2015. The entire contents of these applications are hereby incorporated by reference.

FIELD OF THE INVENTION

The present invention relates to a packaging structure for containers for pharmaceutical use, particularly sterile containers having characteristics of cleanliness that comply with regulations governing pharmaceutical processes. Some of the structures known in the prior art for packaging containers for pharmaceutical use comprise a support surface for the containers which can be seated in a tray and provided with a plurality of seats for precisely accommodating the containers.

The support surface arranges the containers in a matrix-like order and aligns the tops thereof on a single horizontal plane so as to facilitate the automated manipulation of the containers by special robotic manipulators. The containers are maintained separate from one other to prevent them from rubbing against one another and creating contaminating particles. The support surface can be extracted from the tray by means of robotic manipulators designed to transfer the clean, sterile containers to the filling and capping station.

Some phases of the automated process also entail moving the containers away from the support surface, again by means of special robotic manipulators, for example for the weighing phase before and after filling to check the dosage.

The need to extract the containers and convey them for weighing to load cells located in a position remote from the rest surface results in a reduction of the overall production capacity of the entire container processing line.

Moreover, in cases where weighing must be carried out not on randomly selected sample containers but rather on all of the containers, the processing times can be excessively lengthened. The technical task of the present invention is therefore to provide a packaging structure for containers for pharmaceutical use that makes it possible to eliminate the aforesaid technical drawbacks of the prior art.

Within the scope of this technical task, one object of the invention is to provide a packaging structure for containers for pharmaceutical use which is capable of increasing the productivity of a container processing line.

A further object of the invention is to provide a packaging structure for containers for pharmaceutical use that is constructively simple but ergonomic, so as to simplify the automated manipulation of the containers.

The technical task, as well as these and other objects are achieved, according to the present invention, by providing a packaging structure for containers for pharmaceutical use, characterized in that it comprises a support surface for the containers, a tray configured to support the support surface inside it, and demarcation elements which extend on the support surface and delimit with the support surface a plurality of cells, in each of which a container may be positioned, each cell having a bottom wall for supporting the container and side walls for containing the lateral movement of the container, said bottom wall of the cell having along its entire perimeter solid portions for the container to rest on, alternating with empty portions enabling the passage of a device for handling the container.

The present invention further discloses a method for weighing containers for pharmaceutical use, characterized in that it comprises the steps of introducing, into the cells of the packaging structure according to invention, containers conformed in such a way that the perimeter edge of the base thereof rests on the solid portions and lies above the empty portions of the bottom wall of the cells, equipping the handling device with at least one load cell, activating the handling device with a movement that is at least sufficient to pass through said empty portions of the bottom wall of at least one cell, engaging the perimeter edge of the base of said container, and raising the container from the bottom wall of the cell and, by means of the load cell, weighing the container in the raised position.

Advantageously, in the raised position the containers can still be engaged inside their cells at a distance from the bottom wall thereof.

The solid portions are specifically designed to create zones for the perimeter edge of the base of the container to rest upon, appropriate in number, shape and extent in order to ensure that the container rests in a stable position on the bottom wall of the cell; likewise, the empty portions are specifically designed to create zones for the handling device to pass through, appropriate in number, shape and extent in order to ensure that the container rests in a stable position on the handling device also while being raised.

In one embodiment of the invention, the empty portions are defined by a central through opening of the bottom wall of the cell.

The special construction of the cell assures that the perimeter edge of the base of the container will rest upon the bottom wall of the cell in a plurality of discrete zones, and, while the container is being raised, that the perimeter edge of the base of the container will rest upon the handling device in a plurality of discrete zones.

With this special construction of the cell, therefore, the container is stably supported both by the bottom wall of the cell and by the handling device while it is being raised, also in the foreseeable event that the base of the container is not flat, but rather has a concavity facing the outside, so that the area of contact with the bottom wall of the cell or with the handling device is limited to the perimeter edge of the base of the container.

It should also be noted that for the purpose of raising the container it is possible to use different handling devices having a different shape that can mate with one or simultaneously more than one radial branches of the opening.

In a preferred embodiment of the invention, the opening is symmetrical for a rotation of 45°, 30° or 60° and multiples thereof relative to a central axis perpendicular to the support surface.

In one embodiment of the invention the distribution of the cells is symmetrical for a rotation of the support surface of 90° or 180° relative to an axis passing centrally and perpendicularly to the support surface itself.

This special construction of the support surface enables considerable flexibility in the manipulation of the containers, given that the containers in the support surface can be processed automatically by the handling device and by any other robotic manipulator in the same manner in one position of the support surface and in the other position when it is rotated by 90° or 180°. Other characteristics of the present invention are also defined in the claims hereinbelow.

BRIEF DESCRIPTION OF THE DRAWINGS

Additional features and advantages will become more apparent from the description of a preferred, but not exclusive, embodiment of the packaging structure for containers for pharmaceutical use according to the invention, illustrated by way of non-limiting example in the appended drawings, in which.

DETAILED DESCRIPTION

Figure 1:
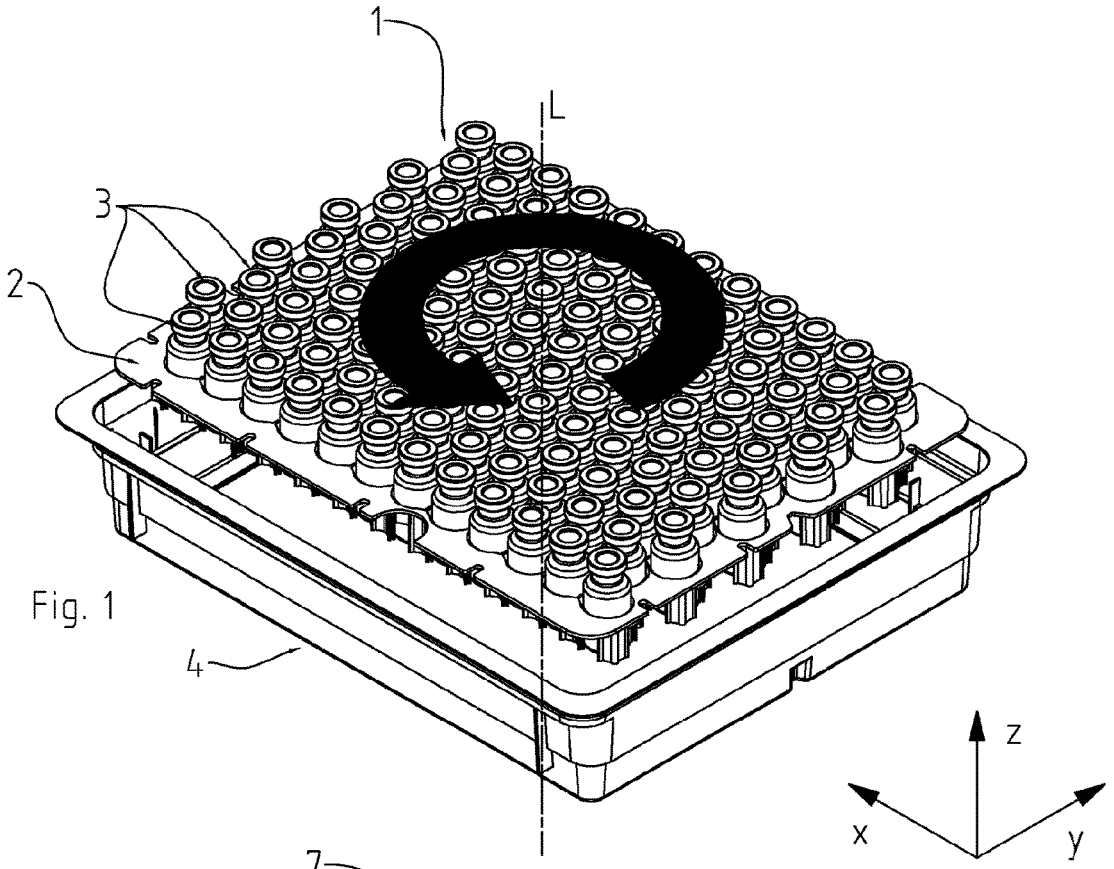
FIG. 1 shows a perspective view of the packaging structure prior to the positioning of the support surface.
Figure 2:
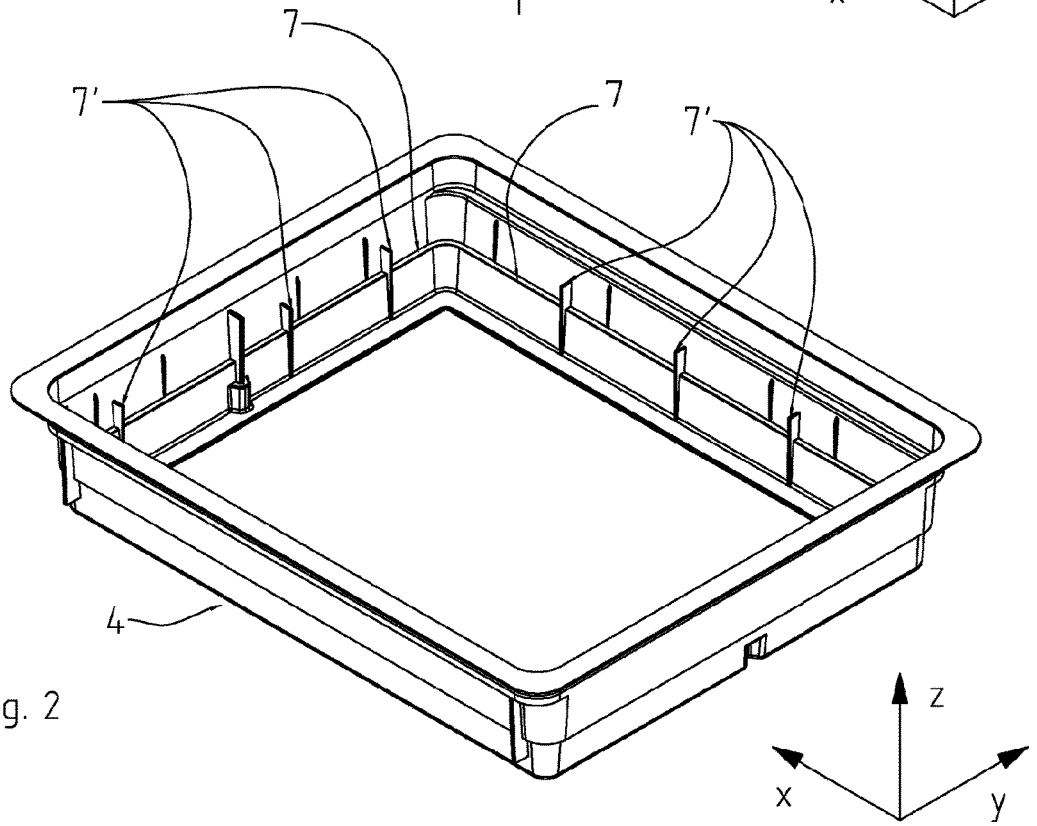
FIG. 2 shows a perspective view of the tray.

With reference to the above-mentioned figures, a packaging structure for containers for pharmaceutical use is shown, denoted in its entirety with the reference number I.

The packaging structure 1 comprises a support surface 2 for the containers 3 and a tray 4 configured to support the support surface 2 inside it.

The containers 3, generally made of glass, preferably have a cylindrical side wall 3*a*, a mouth 3*b* and a base 3*c* exhibiting a slight concavity toward the outside, though other embodiments of the containers 3 are equally conceivable.

The support surface 2 is removably engageable in the tray 4 and has a plurality of cells 5, in each of which a container 3 may be positioned.

The distribution of the cells 5 is symmetrical for a rotation (indicated by an arrow in FIG. 1) of the support surface 2 by 180° relative to an axis L passing centrally and perpendicularly to the support surface 2 itself.

The cells 5, in particular, are ordered according to a two-dimensional matrix in which the cells 5 of one row are offset relative to the cells 5 of the adjacent row. In a different embodiment of the invention, the cells 5 of the adjacent row are also aligned with one another.

Each cell 5 has a bottom wall 9 for supporting the container 3 and side walls 10 for containing the lateral movement of the container 3.

Specific demarcation elements 6 extend on the support surface 2 to delimit the cells 5 in cooperation with the support surface 2.

The bottom wall 9 of the cell 5 is provided by the support surface 2, whilst the side walls 10 of the cell 5 are provided by the demarcation elements 6.

The demarcation elements 6 of the internal cells 5 of the support surface 2 comprise an orderly distribution of pins 19 connected to one another by specific stiffening ribs 20.

The pins 19 are located at the nodes of a grid of regular polygons, for example, but not necessarily, hexagons, whilst the ribs 20 extend along the segments connecting the nodes of the grid. The bottom wall 9 of the internal cells 5 of the support surface 2 thus has a perimeter in the shape of a regular polygon, in particular, but not necessarily, hexagonal. Every node of the grid represents a vertex common to three adjacent hexagons. Each pin 19 has a star-shaped cross section having, in particular, three walls 19*a* facing one another inside the three adjacent hexagons of the grid. The walls 19*a* of the groups of pins 19 facing one another inside the same hexagon circumscribe a cylindrical space of the containers 3 so as to enable the container 3 to be positioned in the cell 5 with minimal lateral play.

The demarcation elements 6 of the perimeter cells 5 of the support surface 2 partly comprise the pins 19 and partly a wall 21 that is perimetric to the support surface 2.

The wall 21 has a height from the supporting surface 2 equal to that of the pins 19.

A flange 22 engageable with the tray 4 extends from the perimeter of the wall 21 towards the outside of the support surface 2.

The support surface 2, the demarcation elements 6, and the flange 22 are preferably made in one piece from plastic.

Advantageously, the bottom wall 9 of the cell 5 has along its entire perimeter solid portions 11 for the container 3 to rest on, alternating with empty portions 12 enabling the passage of a device 13 for handling the container 3.

The empty portions 12 are defined by a central through opening 14 of the bottom wall 9 of the cell 5.

The opening 14 has a main central portion 14*a* and branches 15, 16, 17 that extend radially from the central portion 14*a*.

In particular, there are provided first, second and third branches 15, 16, and 17, respectively, where the opening 14 extends at least for most, and preferably substantially for the entire extent, of a first, second and third diameter D1, D2 and D3, respectively, of the bottom wall 9 of the cell 5.

The first, second and third branches 15, 16, 17 extend in particular along equally angularly spaced diameters D1, D2 and D3, respectively, of the bottom wall 9 of the cell 5.

In the illustrated embodiment, the opening 14 is symmetrical for a rotation of 60° and other multiples of 30° around its central axis perpendicular to the support surface 2.

The packaging structure 1 also comprises a specific means for diversifying the support position of the support surface 2 inside the tray 4.

The diversifying means is suitable for modifying the position of engagement of the support surface 2 in the tray 4 along a direction Z perpendicular to the rest surface 30 for the tray 4 in such a way as to maintain the points inside the tray 4 in which the mouth 3*b* of the containers 3 is positioned unchanged with variations in the height of the containers 3 to be positioned each time in the cells 5.

Figure 3A:
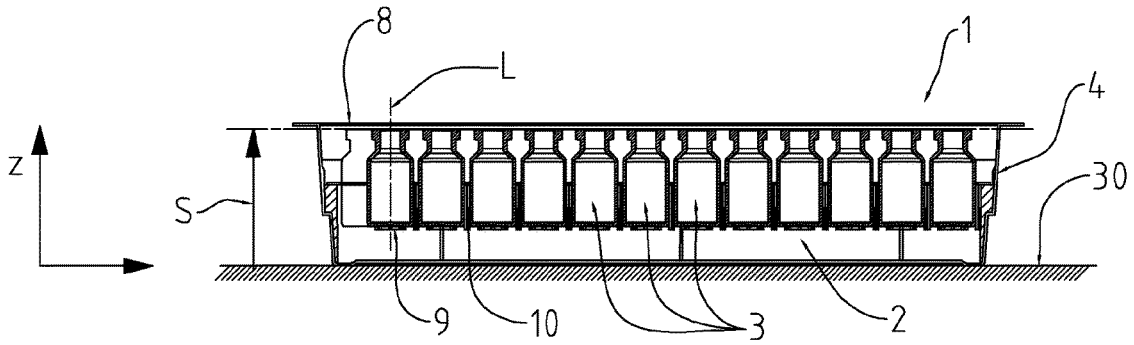
FIGS. 3*a* and 3*b* show a section of the packaging structure in side elevation with the support surface placed in two support positions obtainable by rotating the support surface relative to the tray by 180° around a central axis perpendicular to the support surface, the two support positions enabling the packaging structure to accommodate containers of a different height but placed with their tops at the same distance from the bottom of the tray so as to enable their automated manipulation.
Figure 3B:
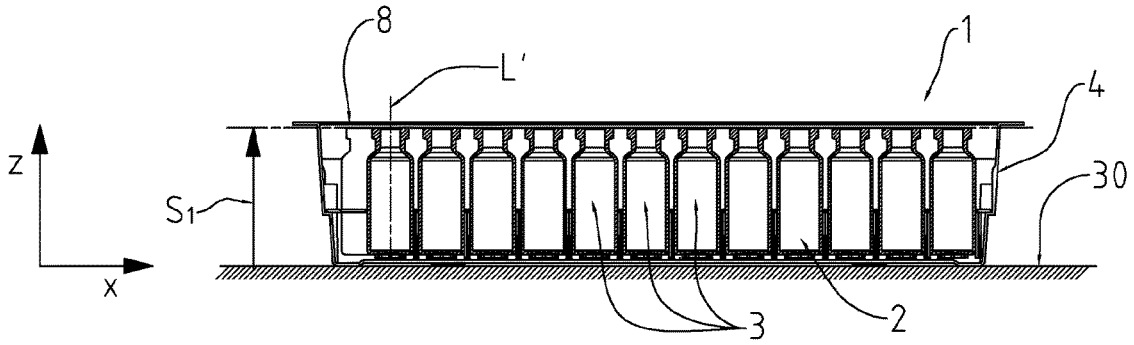
Figure 5:
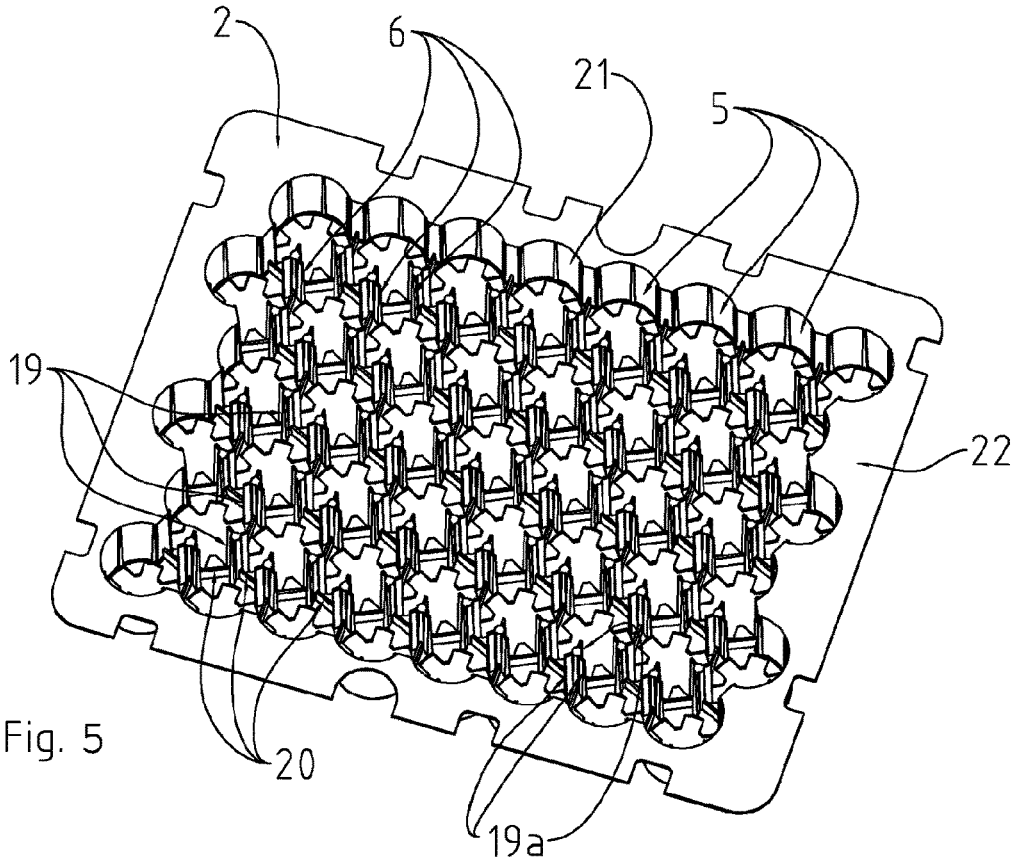
FIG. 5 shows a perspective view of the support surface.
Figure 4:
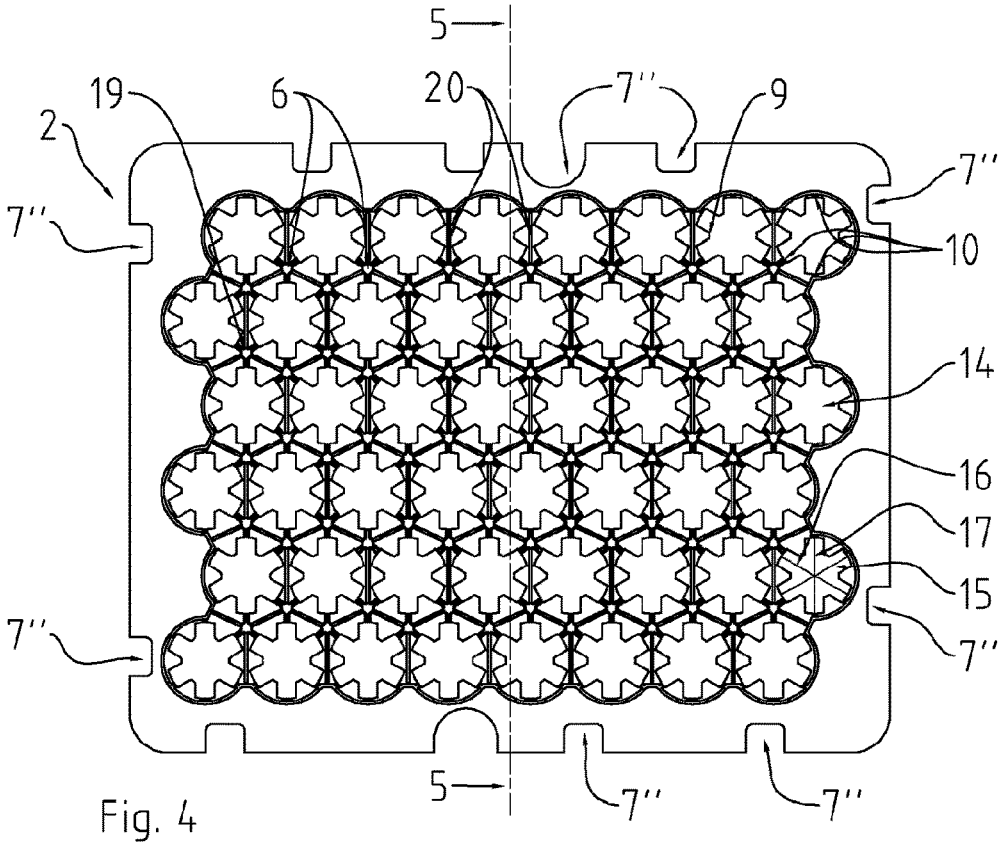
FIG. 4 shows a plan view of the support surface.

From a comparison between FIGS. 3*a* and 3*b*, it may be noted that, if the position of the support surface 2 is rotated relative to the tray 4 in order to accommodate containers 3 of a different height, the distance S of the end 3*a* of a container 3 from the rest surface 30 is equal to the distance S' of the end 3*a* of a taller container 3 from the rest surface 30.

The diversifying means comprises matching parts 7' and 7" reciprocally engageable along inner side walls of the tray 4 and along the perimeter edge of the flange 22, respectively. When they are aligned, the matching parts 7', 7" can engage reciprocally so as to enable the flange 22 to rest upon an internal perimeter ledge 7 of the side walls of the tray 4. By contrast, when they become unaligned as a result of a 180° rotation of the support surface 2 around the axis L relative to the tray 4, the matching parts 7', 7" cannot reciprocally engage: the flange 22 interferes with the matching parts 7', which hold up the support surface 2 at a larger distance from the bottom of the tray 4 than in the previously described situation.

Finally, the packaging structure 1 comprises a cover 8 for an airtight or filtering closure of the tray 4, which may be applied on the open side of the tray 4 from which the support surface 2 is introduced and extracted.

The cover 8 can be made from a layer of material that is selectively permeable to a sterilizing agent suitable for sterilizing the containers 3, and in particular a layer associated in a peelable manner, for example heat-sealed, to the tray 4.

The tray 4 can have associated with it an identification and traceability element (not shown), for example a code that can be decoded using RFID technology.

If the containers present in the packaging structure arrive at the pharmaceutical companies already washed and sterilized, the subsequent steps, to be carried out at the pharmaceutical company, consist in weighing the containers prior to filling, filling them, weighing them after filling to check the dosage and capping them.

Weighing can be performed for all of the containers or samples thereof. Weighing can be performed with the aid of one or more handling devices 13 that work in an independent or synchronized manner.

For the purpose of weighing the container 3, the handling device 13 is equipped with a load cell and positioned beneath the support surface 2 in a position vertically aligned with the cell 5 which accommodates the container 3.

The container 3 is initially coaxially positioned in the corresponding cell with the perimeter edge 3*d* of its base resting upon the solid portions 11 and lying above the empty portions 12 of the bottom wall 9 of the cell 5.

The handling device 13 is made to translate vertically upward in a direction perpendicular to the support surface 2 so as to complete a movement that is at least sufficient to pass through the empty portions 12, engage the perimeter edge 3*d* of the base 3*c* of the container 3 and thus raise the container 3 from the bottom wall 9 of the cell 5.

For the purpose of raising the container 3, use can be made of different handling devices 13 having a different shape that can mate with one or simultaneously more than one radial branches of the opening 14.

Figure 6A:
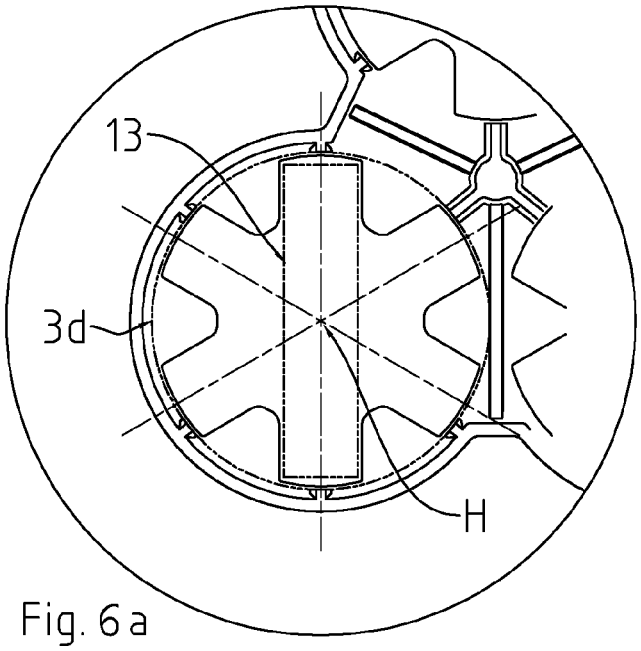
FIGS. 6*a* and 6*b* show a schematic plan view of two variant embodiments of the handling device positionable beneath the cell in order to raise the container.
Figure 6B:
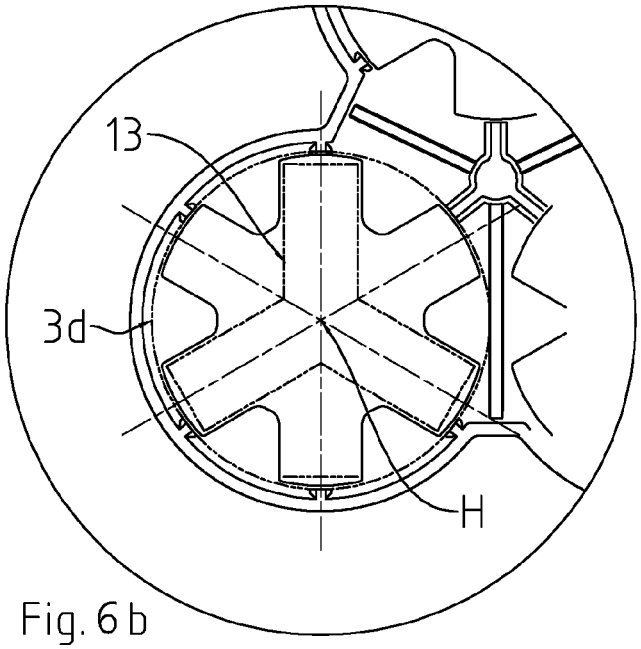

The handling device 13 in FIG. 6*b* has three identical wings that extend 120° from one another relative to the central axis of movement H of the handling device 13 itself. In the configuration illustrated in FIG. 6*b*, the handling device 13 touches the perimeter edge of the base 3*c* of the container 3 in no fewer than three distinct zones that are equally angularly spaced, and as a result the container 3 remains stably balanced on the handling device. 13. There are moreover no fewer than six different angular orientations obtained through successive 60° rotations around its central axis of movement H, whereby the handling device 13 can be introduced into the opening 14 so as to touch the perimeter edge 3*d* of the base 3*c* of the container 3 in no fewer than three distinct equally angularly spaced zones.

Advantageously, if the opening 14 is symmetrical for the rotation of Multiples of 30° around its central axis perpendicular to the support surface 2, when the support surface 2 is rotated by 180° in the Z axis relative to the tray 4, the layout of the opening 14 will not vary: when the handling device 13 illustrated in FIG. 3*b* is used to weigh the container, it is therefore not necessary to verify a priori the orientation of the support surface 2 relative to the tray 4. The handling device 13 in FIG. 6*a* has two identical wings which extend 180° from each another relative to the central axis of movement H of the handling device 13 itself.

Figure 7:
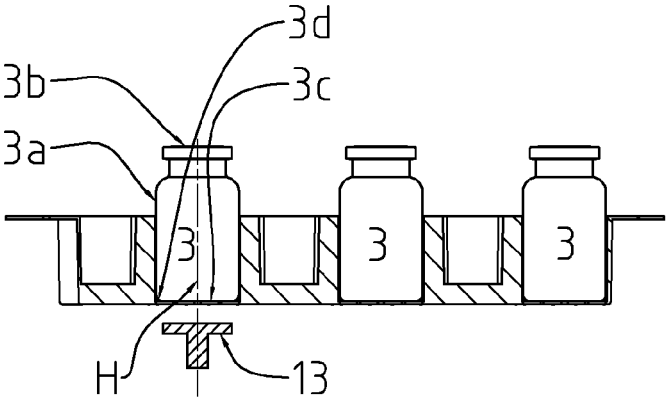
FIGS. 7 and 8 show schematic side elevation views of the container in a position of resting on the bottom wall of the cell and in a raised position following the activation of the handling device.
Figure 8:
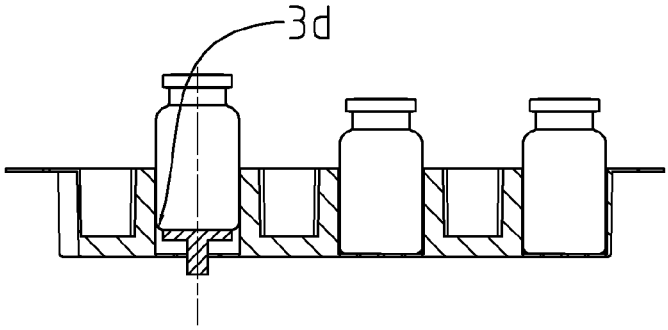
Figure 9:
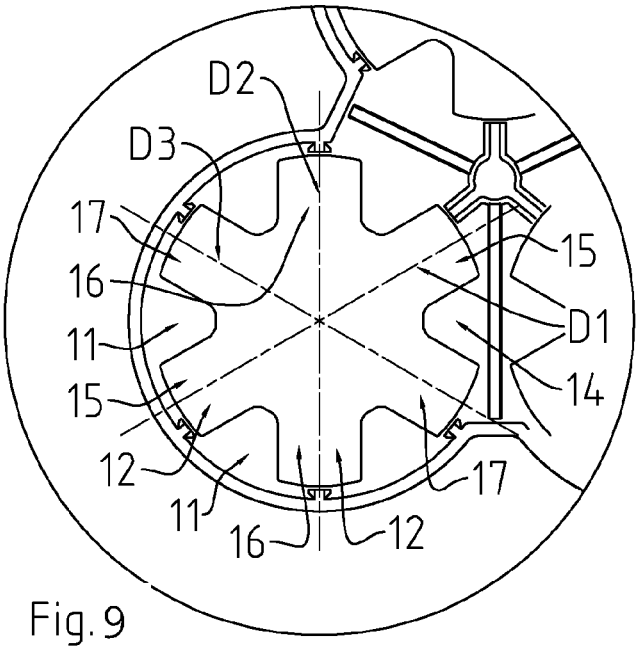
FIG. 9 shows an enlargement of the profile in a plan view of the opening in the bottom wall of the cell of positioning of a container.

In the configuration illustrated in FIG. 7, the handling device 13 touches the perimeter edge 3*d* of the base 3*c* of the container 3 in two distinct diametrically opposed zones, and as a result the container 3 remains stably balanced on the handling device 13 in this case as well. In this case, too, there are no fewer than six different angular orientations obtained through successive 60° rotations around its central axis of movement H, whereby the handling device 13 can be introduced into the opening 14 so as to touch the perimeter edge 3*d* of the base 3*c* of the container 3 in two distinct equally angularly spaced zones.

In the position in which it is raised from the bottom wall 9 of the cell 5 the container 3 is weighed by the load cell.

After weighing, the handling device 13 is made to translate vertically downward with a movement opposite the preceding one, which brings the container 3 back to rest on the bottom wall 9 of the cell 5.

The handling device 13 can also be equipped with a system (not shown) for retaining the container 3, which is useful particularly if the handling device for weighing extracts the container 3 completely from the cell 5.

In particular, the retaining device can be movable through the central portion 14*a* of the opening 14 and can consist in a decompression suction system, for example a suction cup, applicable to the base of the container 3 in order to keep the container 3 in movement firmly constrained to the handling device 13.

It must be noted that the particular design of the cells of the support surface is specifically conceived so as to provide pharmaceutical companies with containers that can be manipulated in an automated manner for pre-filling weighing, filling, post-filling weighing and capping operations without completely extracting them from the cells of the support surface. Consequently, the production capacity of the container processing line is considerably increased compared to traditional processing lines where the containers are completely extracted from the packaging structure in order to be processed.

The packaging structure for containers for pharmaceutical use thus conceived is susceptible of numerous modifications and variants, all falling within the scope of the inventive concept; moreover, all the details may be replaced with technically equivalent elements. The materials used, as well as the dimensions, may in practice be of any type, according to needs and the state of the art.

The invention claimed is:

1. A packaging structure for containers for pharmaceutical use, comprising:

a support surface for the containers, a tray configured to support the support surface from the inside, and demarcation elements which extend on the support surface and delimit with the support surface a plurality of cells, in each of which the container is positioned, wherein each cell comprises:

a bottom wall supporting the container; and side walls for containing the lateral movement of the container, wherein said bottom wall of the cell comprises, along its entire perimeter, solid portions for the container to rest on, alternating with empty portions enabling the passage of a device for handling the container, wherein said empty portions are defined by a central through opening of the bottom wall of the cell, wherein said opening has a main central portion and branches that extend radially from the central portion, wherein said opening, in first, second and third branches, respectively extends for most of a first, second and third diameter, respectively, of the bottom wall of the cell, and wherein said first, second and third diameter are equally angularly spaced.

2. The packaging structure for containers for pharmaceutical use according to claim 1, wherein said bottom wall is provided by the support surface and said side walls are provided by the demarcation elements.

3. The packaging structure for containers for pharmaceutical use according to claim 1, wherein said opening is symmetrical for a rotation of 45°, 30° or 60° and multiples thereof relative to a central axis perpendicular to the support surface.

4. The packaging structure for containers for pharmaceutical use according to claim 1, wherein the distribution of the cells is symmetrical for a rotation of the support surface of 90° or 180° relative to an axis passing centrally and perpendicularly to the support surface itself.

5. The packaging structure for containers for pharmaceutical use according to claim 1, wherein said cells are ordered according to a two-dimensional matrix in which the cells of one row are offset relative to the cells of the adjacent row.

6. The packaging structure for containers for pharmaceutical use according to claim 1, wherein it comprises matching parts for diversifying the support position of the support surface inside the tray.

7. The packaging structure for containers for pharmaceutical use according to claim 1, further comprises a cover for an airtight or filtering closure of the tray applied on the open side of the tray, from which the support surface is introduced.

8. A use of a packaging structure in accordance with claim 1 for packaging sterile containers for pharmaceutical use.

9. A method for weighing containers for pharmaceutical use, comprising the steps of:

introducing, into the cells of a packaging structure in accordance with claim 1, containers conformed in such a way that the perimeter edge of the base thereof rests on the solid portions and lies above the empty portions of the bottom wall of the cells;

equipping the handling device with a load cell;

activating the handling device with a movement that is at least sufficient to pass through said empty portions of the bottom wall of at least one cell;

engaging the perimeter edge of the base of said container, raising the container from the bottom wall of the cell and, weighing, by the load cell, the container in the raised position.

* * * * *